United States Patent [19]

Tone

[11] Patent Number: 4,988,050

[45] Date of Patent: Jan. 29, 1991

[54] METHOD OF CONTROLLING YARN JOINING OPERATION

[75] Inventor: Shoichi Tone, Kyoto, Japan

[73] Assignee: Murata Kikai Kabushiki Kaisha, Kyoto, Japan

[21] Appl. No.: 378,326

[22] Filed: Jul. 11, 1989

[30] Foreign Application Priority Data

Jul. 15, 1988 [JP] Japan ..... 63-175065

[51] Int. Cl.[5] ..... B65H 54/22

[52] U.S. Cl. ..... 242/35.6 O R

[58] Field of Search ..... 242/35.6 R, 35.5 R, 242/36, 37 R

[56] References Cited

U.S. PATENT DOCUMENTS 2,733,870 2/1956 Furst ..... 242/35.6 R
2,769,599 11/1956 Furst ..... 242/35.6 R
3,304,015 2/1967 Jenny ..... 242/35.6 R
3,373,946 3/1968 Prasil ..... 242/35.6 R
3,776,479 12/1973 Lutovsky et al. ..... 242/35.6 R
3,834,634 9/1974 Havlas et al. ..... 242/35.6 R

*Primary Examiner*—Stanley N. Gilreath
*Attorney, Agent, or Firm*—Spensley Horn Jubas & Lubitz

[57] ABSTRACT

The present invention provides a method of controlling yarn joining operation on the basis of signals provided by a slub catcher which generates a yarn breakage signal upon the detection of a slub during winding a yarn being supplied from a yarn supply bobbin on a take-up package. A change of a yarn supply bobbin for a new yarn supply bobbin and a yarn joining operation are conducted upon detection of the slub catcher whether a yarn breakage is occurred and/or detection of the yarn absence under what conditions.

9 Claims, 7 Drawing Sheets

METHOD OF CONTROLLING YARN JOINING OPERATION

FIELD OF THE INVENTION

The present invention relates to a method of controlling yarn joining operation on the basis of signals generated by a slub catcher in winding a yarn supplied from a yarn supply bobbin on a take-up package in a winder.

RELATED ART STATEMENT

Japanese Pat. Publication No. 61-42708 discloses a yarn joining technique, in which a yarn being supplied from a yarn supply bobbin is wound on a take-up package in a winder is cut and winding operation is interrupted upon the detection of a slub in the yarn by a slub catcher, the yarn extending from the yarn supply bobbin and the yarn extending from the take-up package are joined together by a yarn joining device, and then winding operation is restarted.

The yarn extending from the yarn supply bobbin and the yarn extending from the take-up package are guided by a suction arm so that the respective free ends of the yarns intersect each other on the yarn joining device. The free end of the yarn of the supply package is held by suction by a yarn trap in order to enable the suction arm readily to catch the free end thereof.

However, yarn joining operation is impossible in case the yarn trap has failed to catch the free end of the yarn of the yarn supply bobbin and the yarn end remains free or in case the yarn supply bobbin has been exhausted. In such a case the exhausted yarn supply bobbin must be changed for a new yarn supply bobbin. As shown in FIG. 3, a yarn detector 20, i.e., a so-called yarn feeler, is provided below the yarn trap 8 to detect if the yarn is held by suction by the yarn trap 8. Yarn joining operation is executed when the yarn detector 20 detects a yarn on the yarn trap 8, while yarn supply bobbin changing operation is executed when no yarn is detected on the yarn trap 8.

However, since this yarn detector 20 is a gate type yarn feeler comprising a pair of swing gates 20*a* and 20*b* between which a yarn passes, the yarn detector requires a comparatively large space for installation increasing the height of the winder and is liable to malfunction due to the hindrance of the motion of the swing gates 20*a* and 20*b* with waste fibers. Furthermore, a spring urging the swing gates 20*a* and 20*b* toward each other requires difficult adjustment, and the gate type yarn detector 20 is liable to cause the surface of the yarn to fluff and increases the tension of the yarn causing yarn breakage when the winder operates at a comparatively high winding speed.

OBJECT AND SUMMARY OF THE INVENTION

It is an object of the present invention to provide a method of controlling yarn joining operation without using of the gate type yarn detector, whereby the height of the winder can be decreased and the winder may be operated at a comparatively high winding speed.

To achieve this object of the invention, an embodiment of the present invention provides a method of controlling yarn joining operation on the basis of signals provided by a slub catcher which generates a yarn breakage signal upon the detection of a slub during winding a yarn being supplied from a yarn supply bobbin on a take-up package, wherein a change of a yarn supply bobbin for a new yarn supply bobbin is conducted when the slub catcher detects the absence of yarn therein and the absence of yarn therein after an advancing of a yarn end toward the take-up package, while a yarn joining operation is conducted to join together the yarn pulled out from the take-up package and the yarn pulled out from the yarn supply bobbin when the slub catcher detects yarn breakage or the absence of yarn therein after the retraction of an end of the yarn supplied from the yarn supply bobbin.

In the present invention, yarn supply bobbin changing operation or yarn joining operation is executed on the basis of the result of decision of the condition of the yarn by a slub catcher instead of a gate type yarn detector.

Accordingly, the method of controlling yarn joining operation without using the gate type yarn detector eliminates the adjustment of the spring of the gate type yarn detector, the necessity of increasing the height of a winder for providing gate type yarn detectors thereon and problems resulting from erroneous yarn detection and the fluffing of the yarn, and enables the winder to operate at a comparatively high winding speed.

DETAILED DESCRIPTION OF PREFERRED EMBODIMENTS

A method of controlling yarn joining operation, embodying the present invention will be described hereinafter with reference to the accompanying drawings.

Figure 1:
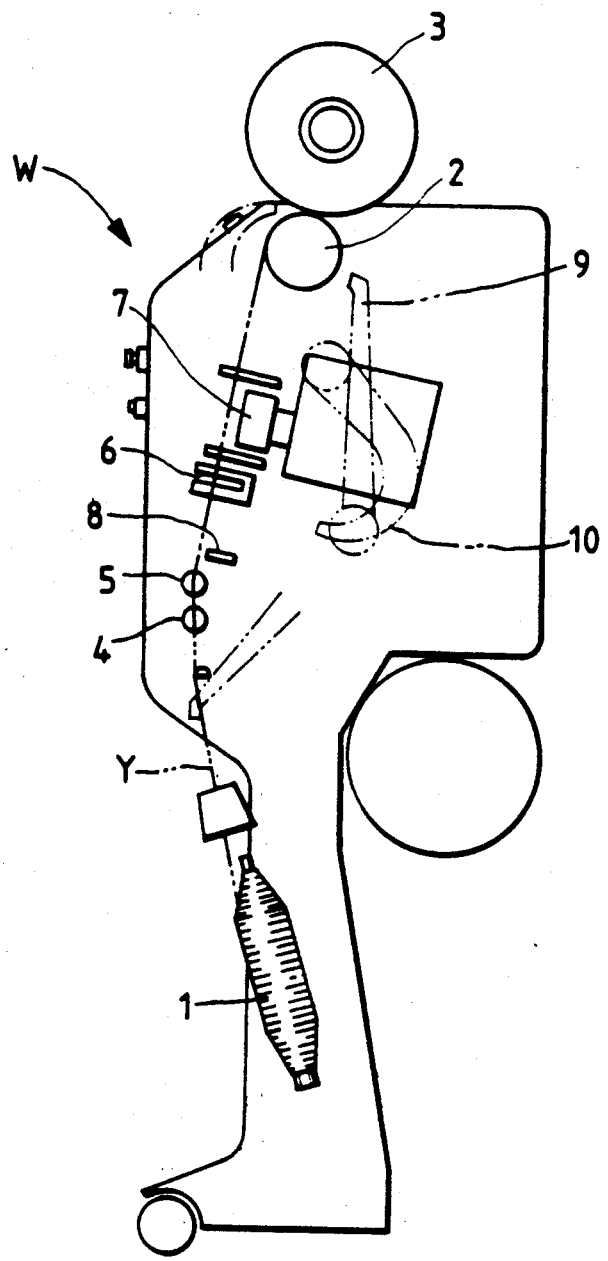
FIG. 1 is a schematic sectional side elevation showing the general construction of a winder for carrying out a method of controlling yarn piecing operation embodying the present invention.
Figure 3:
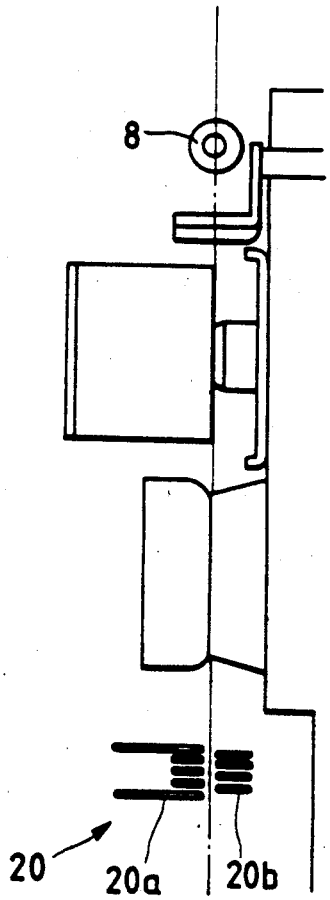
FIG. 3 is a schematic view showing a gate type yarn detector provided on a conventional winder.

Referring to FIG. 1 schematically showing the general construction of a winder, a yarn supply bobbin 1 is disposed substantially in an upright position below a winding unit W, and a yarn Y pulled out from the supply package 1 is wound up on a take-up package 3 rotated by a rotary drum 2 disposed in the upper section of the winding unit W. A tension device 4 for controlling the tension of the yarn Y at a predetermined degree, a waxing device 5, a slub catcher 6 for catching slubs in the yarn Y, and a yarn joining device 7 are arranged in that order along a yarn path between the yarn supply bobbin 1 and the take-up package 3. A yarn trap 8 is disposed between the waxing device 5 and the slub catcher 6 to hold the free end of the yarn Y extending from the yarn supply bobbin 1 by suction when the yarn Y is cut upon the detection of a slub by the slub catcher 6. A cutter, not shown, is disposed near the slub catcher 6 to cut the yarn Y when the slub catcher 6 generates a yarn cut signal upon the detection of a slub.

The winding unit W is provided further with a first suction arm 9 for sucking and taking the free end of the yarn Y held by the yarn trap 8 to the yarn joining device 7, and a second suction arm 10 for sucking and taking the free end of the yarn Y extending from the take-up package 3 to the yarn joining device 7. The yarn joining device 7 splicing together the free ends of the yarns Y by the agency of a whirling air current. The yarn trap 8 and the first and second suction arms suck and hold the free end of the yarn by a suction air stream.

In the winding unit W mentioned above, a yarn joining operation control using a slub catcher is conducted as described hereinafter.

A yarn joining operation control mode will be described hereinafter.

The yarn supply bobbin 1 is changed for a new yarn supply bobbin in case the slub catcher 6 has detected the absence of yarn therein and in case the absence of yarn therein after an advancing of a yarn end toward the take-up package 3. The yarn end of the yarn supply bobbin 1 and that of the take-up package 3 are joined together in case the slub catcher 6 has provided a yarn breakage signal and in case the slub catcher 6 has detected the absence of yarn after the retraction of the yarn end of the yarn supply bobbin 1 therefrom.

The absence of yarn means a state in which any yarn Y is not present in the slub catcher 6. The absence of yarn after the advancing or a yarn end toward the take-up package means a state in which the yarn end of the yarn Y extending from the yarn supply bobbin 1 has been taken up on the take-up package 3 and any yarn Y is present in the slub catcher 6. Such a state occurs when the yarn supply bobbin 1 has been exhausted or when the yarn Y is broken due to an excess tension before the slub catcher 6, (that is, the yarn supply bobbin side). The absence of yarn after the retraction of the yarn end means a state in which the yarn Y is broken due to an excess tension after the slub catcher 6 and the yarn Y extending from the yarn supply bobbin 1 has been retracted from the slub catcher 6 by the yarn trap 8. The exhaustion of the yarn supply bobbin means a state in which all the yarn Y wound on the yarn supply bobbin 1 has been taken up on the take-up package 3. These cases are tabulated in the appended Table 1.

Figure 2A:
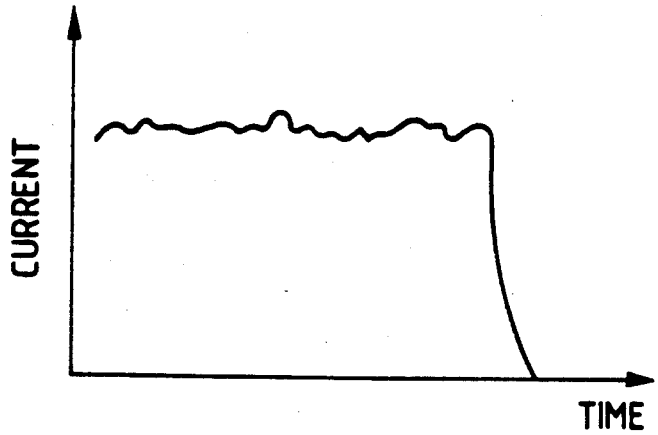
FIGS. 2*a* and 2*b* are graphs of assistance in explaining the variation of a detection signal provided by a slub catcher.
Figure 2B:
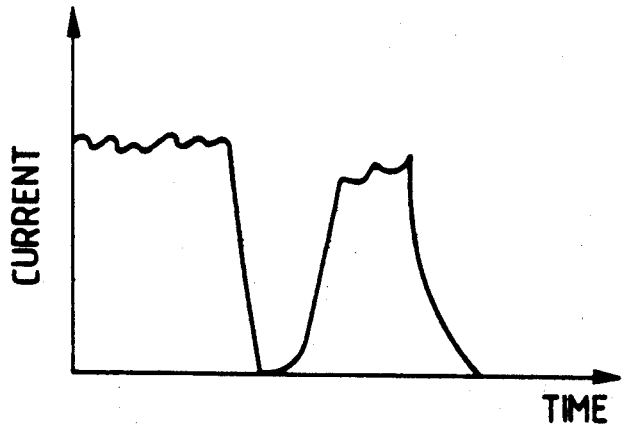

As shown in Table 1, the slub catcher 6 provides a yarn breakage signal only when a slub is detected and does not provide any yarn breakage signal in other cases. In case the yarn supply bobbin 1 has been exhausted (exhaustion of yarn supply bobbin) or the yarn Y is broken before the slub catcher (yarn breakage before the slub catcher), the yarn Y runs through the slub catcher 6 toward the take-up package 3 and, finally, the trailing end of the yarn Y leaves the slub catcher 6. Consequently, the level of the detection signal provided by the slub catcher 6 changes in a mode as shown in FIG. 2*a* and thereby the yarn supply bobbin changing operation is started. In case the yarn Y is broken after the slub catcher 6 (yarn breakage after the slub catcher), the yarn Y advancing through the slub catcher 6 stops due to yarn breakage, and then the yarn Y remaining in the slub catcher 6 is retracted by the yarn trap 8 and, finally, the leading end of the yarn Y leaves the slub catcher 6. Consequently, the level of the detection signal provided by the slub catcher 6 changes in a mode as shown in FIG. 2*b* and thereby the yarn joining operation is started.

On the other hand, a state of the slub catcher 6 in which the leading end of the yarn Y of the yarn supply bobbin 1 is laid in the slub catcher 6 or a state of the same in which the leading end of the yarn Y of the yarn supply bobbin 1 is not laid in the slub catcher 6 is stored in a memory during the yarn joining operation. When the yarn joining operation is unsuccessful, the yarn joining operation is started again when the state in which the leading end of the yarn Y of the yarn supply bobbin 1 is laid in the slub catcher 6 is stored in the memory, or the yarn supply bobbin changing operation is started when the state in which the leading end of the yarn Y of the yarn supply bobbin 1 is not laid in the slub catcher 6 is stored in the memory. When no yarn is detected by the slub catcher 6 or when the yarn disappears from the slub catcher after the yarn Y has once been detected by the slub catcher 6, after the winding operation has been restarted subsequent to the completion of the yarn joining operation, it is decided that the yarn joining operation has failed, and then the yarn joining operation is started again. When the unsuccessful yarn joining operation is repeated by predetermined times, the yarn joining operation is stopped and a pilot lamp indicating the incompletion of the yarn joining operation is lighted up for the winding unit W.

Figure 4:
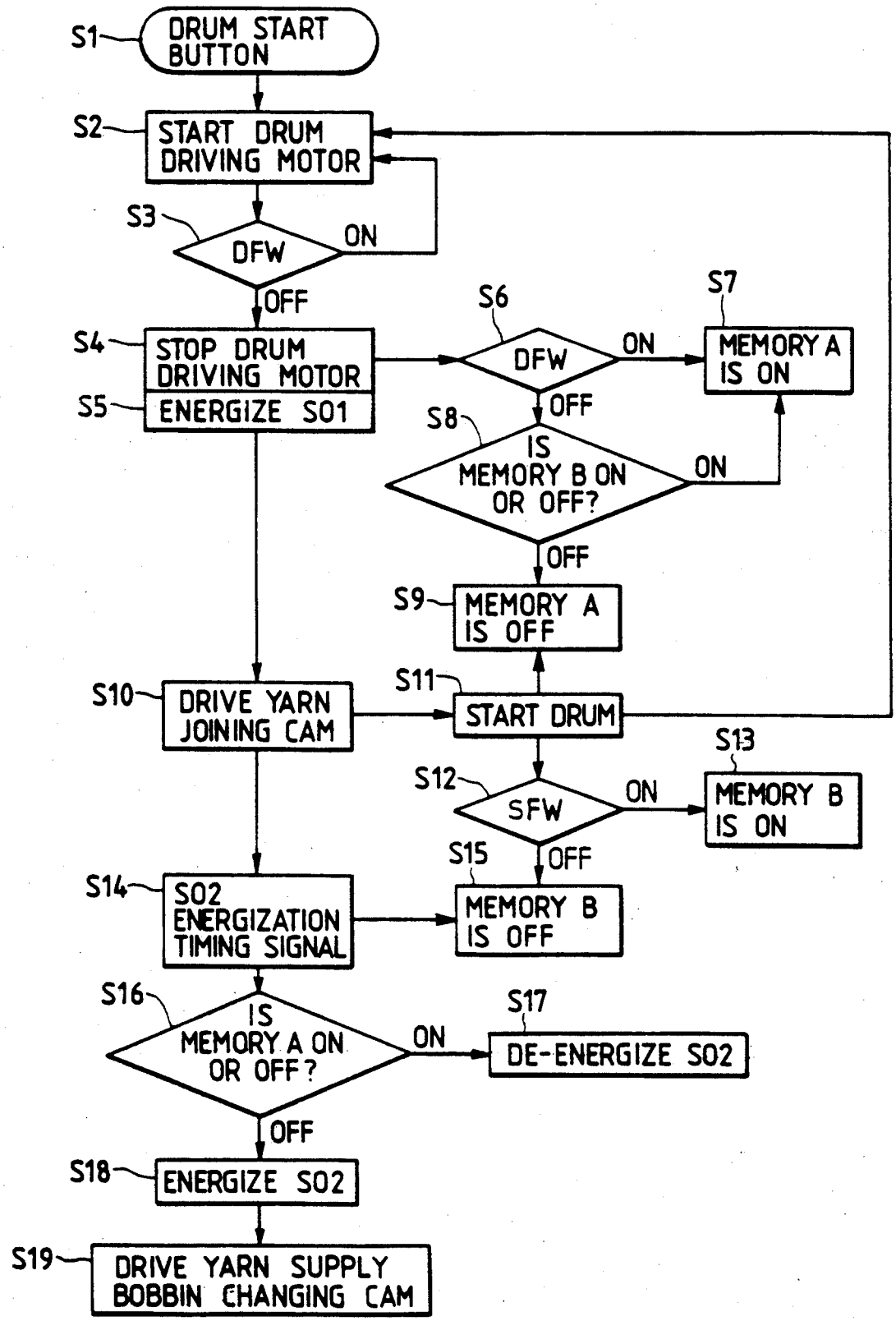
FIG. 4 is a flow chart of assistance in explaining steps of a method of controlling yarn joining operation in accordance with an embodiment of the present invention.

The method of controlling yarn joining operation is carried out by a procedure represented by a flow chart shown in FIG. 4. In FIG. 4, "drum driving motor" is a motor for driving the drum 2 (FIG. 1) SOl is a solenoid coil for driving a yarn joining cam included in the yarn joining device 7, and SO2 is a solenoid coil for driving a supply package changing cam included in a yarn supply bobbin changing mechanism. DFW is a signal provided by the slub catcher 6 and ON of DFW shows that a yarn is running through the slub catcher 6. SFW is a yarn detection signal which shows present or absence in the slub chatcher 6 and ON of SFW shows a yarn is present in the slub catcher 6. CAS in FIGS. 5, 6 and 7 is a cutter actuation signal and ON of CAS shows an actuation of the cutter, that is, issue of a yarn cutting signal.

Figure 5:
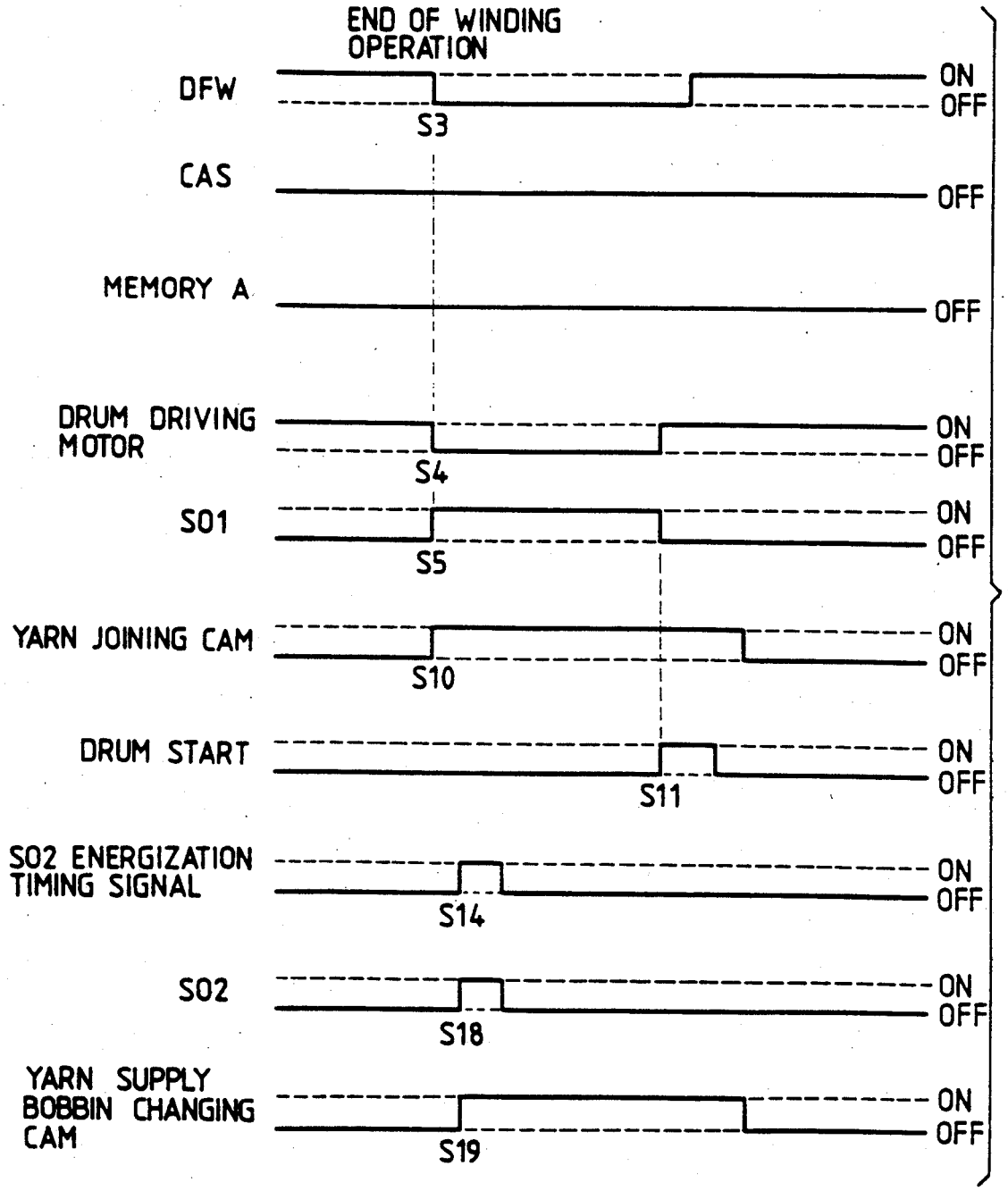
FIGS. 5 to 8 are time charts of assistance in explaining a series of steps of yarn joining operation and yarn supply bobbin changing operation.

FIG. 5 is a time chart of assistance in explaining the yarn supply bobbin changing operation. When the yarn supply bobbin is exhausted, the cutter actuation signal CAS is not issued and the signal DFW goes OFF, and thereby the drum driving motor is stopped in step S4 according to the yarn absence signal, OFF of DFW, the solenoid coil SOl is energized in step S5 to rotate the yarn joining cam in step S10. In this state, the signal DFW is OFF (step S6), a memory B is OFF (step S8), and hence a memory A is OFF (step S9). Consequently, when the memory A is OFF (step S16), the solenoid coil SO2 is energized in step S18 at a solenoid coil energizing timing signal to drive the supply package changing cam in step S19.

Figure 6:
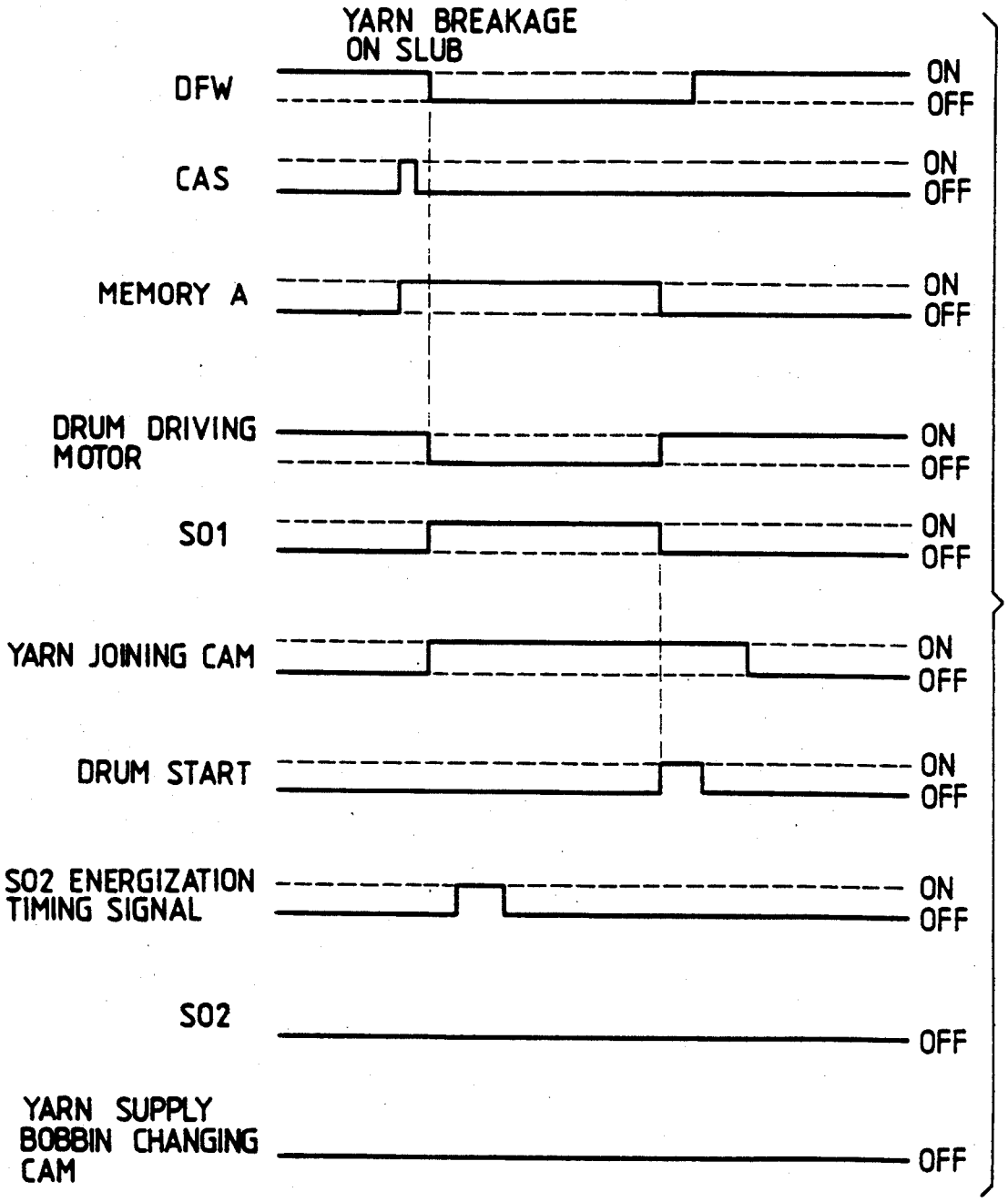

FIG. 6 is a time chart of assistance in explaining the yarn joining operation in case the cutter actuation signal CAS on slub is ON. In this case, the memory A is ON, and hence the solenoid coil SO2 is not energized. Consequently, the yarn supply bobbin changing operation is not executed and only the yarn joining operation is executed.

Figure 7:
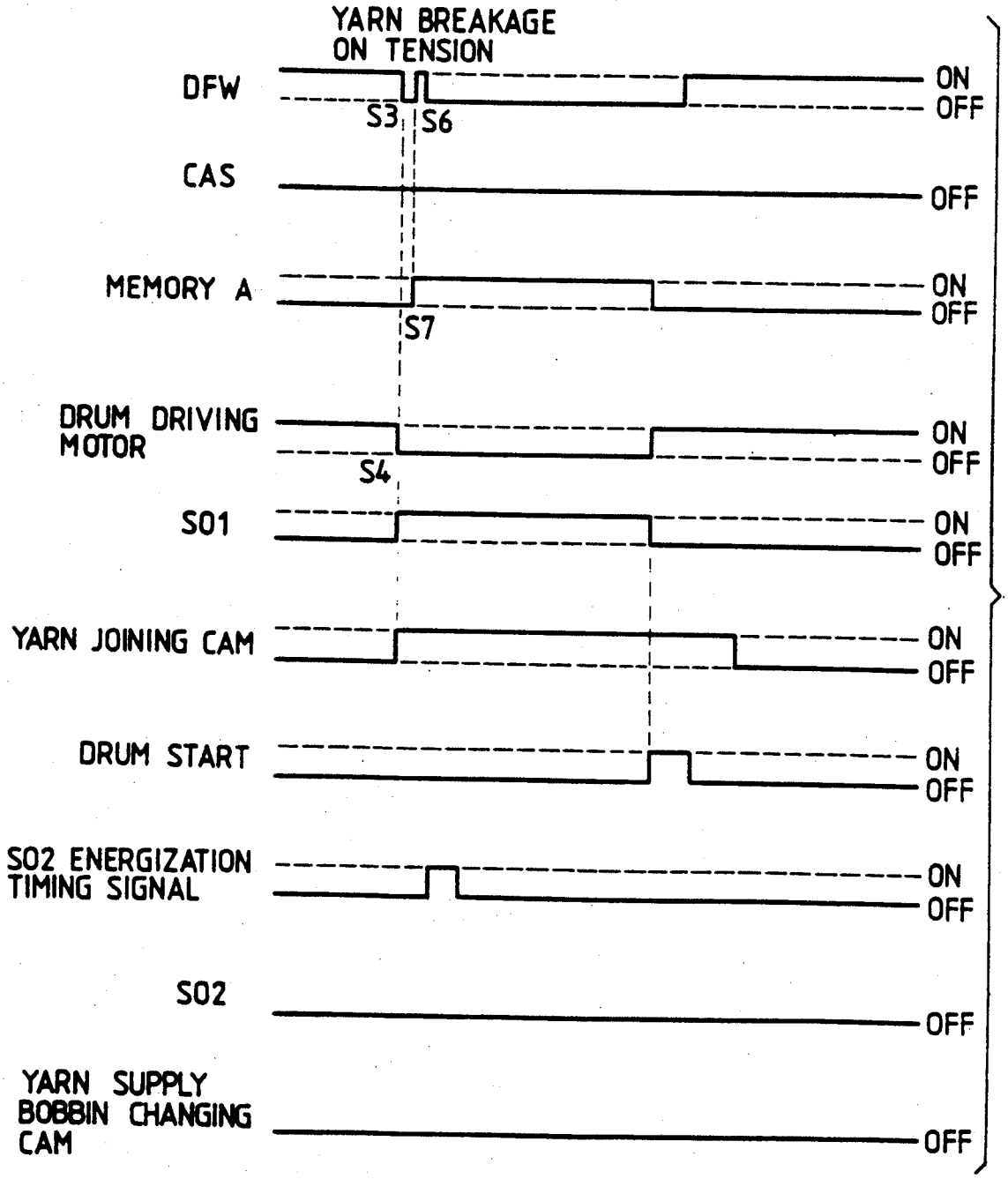

FIG. 7 is a time chart of assistance in explaining the yarn joining operation in case the yarn is broken after the slub catcher 6. In this case, the memory A is ON, and hence the yarn supply bobbin changing operation is not executed and only the yarn joining operation is executed.

Figure 8:
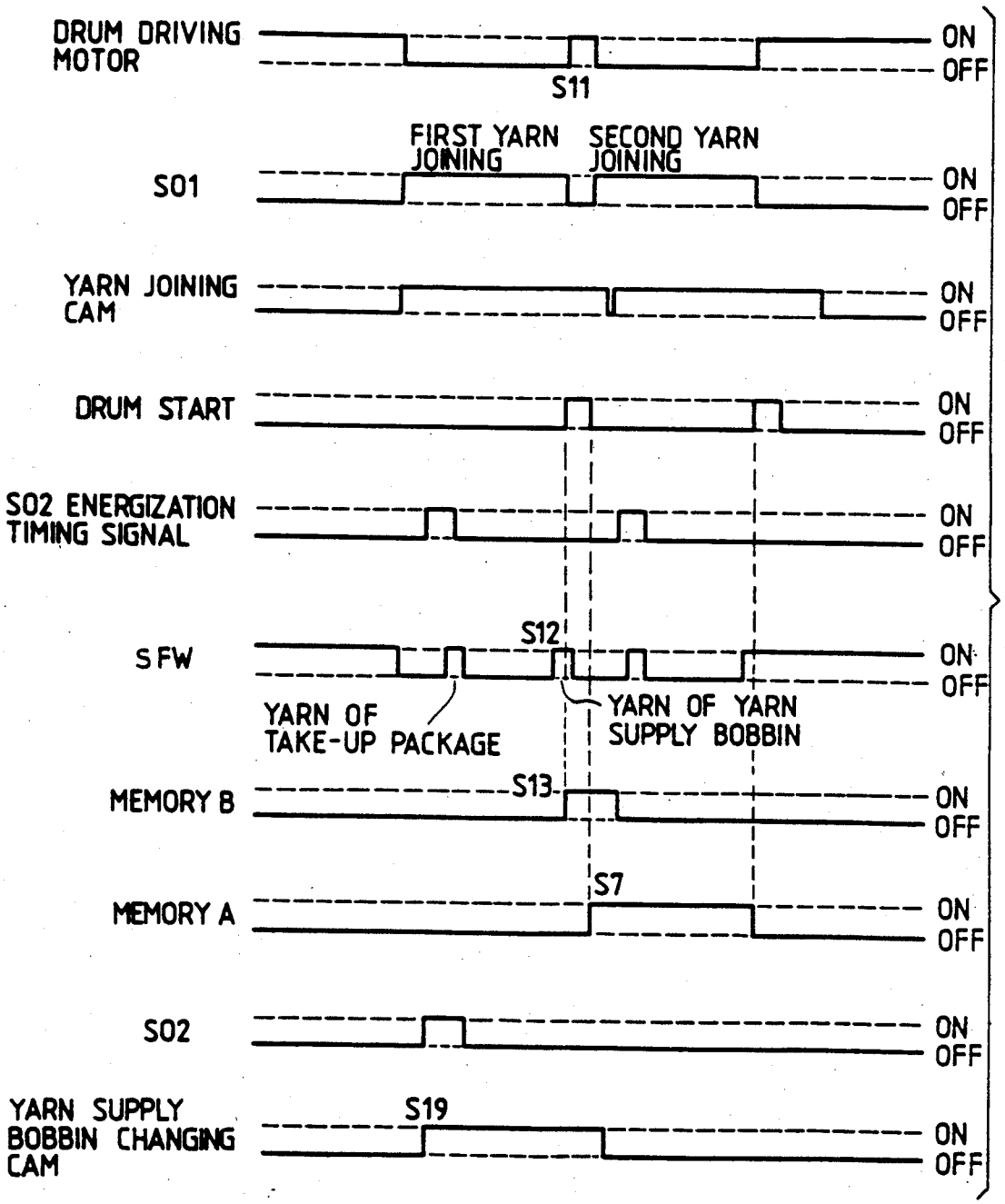

FIG. 8 is a time chart of assistance in explaining the yarn joining operation in case the yarn joining operation is unsuccessful and the leading end of the yarn of the yarn supply bobbin is in the slub catcher 6. In this case, only the joining operation is executed without executing the yarn supply bobbin changing operation for the second time.

Thus, the condition of the yarn is decided on the basis of the signal provided by the slub catcher 6, and then the yarn supply bobbin changing operation and the yarn joining operation are controlled accordingly.

Since the slub catcher 6 thus functions also as a gate type yarn detector, the winder need not be provided with any gate type yarn detector, and hence the troublesome spring adjustment is eliminated, the height of the winder need not be increased to provide gate type yarn detectors thereon, problems resulting from the malfunction of the gate type yarn detector clogged with waste fibers and the fluffing of the yarn are solved, and the winder is able to operate at a comparatively high winding speed.

As is apparent from the foregoing description, according to an embodiment of the present invention, the yarn supply bobbin changing operation or the yarn joining operation is executed on the basis of a signal provided by the slub catcher instead of a gate type yarn detector, indicating the condition of the yarn. Accordingly, the winder need not be provided with any gate type detector, the troublesome spring adjustment is unnecessary, the height of the winder need not be increased to provide gate type yarn detectors thereon, and the erroneous detection of the condition of the yarn by the gate type yarn detector clogged with waste fibers is eliminated.

TABLE 1

| Condition immediately before Yarn joining operation | Condition of slub catcher | Operation |
|---|---|---|
| Yarn supply bobbin exhaustion | No yarn breakage signal<br>No yarn after advancing of a yarn end | Yarn supply bobbin changing operation |
| Slub | Yarn breakage signal | Yarn joining operation |
| Yarn breakage after slub catcher | No yarn breakage signal<br>No yarn after retraction of a yarn end | Yarn joining operation |
| Yarn breakage before slub catcher | No yarn breakage signal<br>No yarn after advancing of a yarn end | Yarn supply bobbin changing operation |
| Unsuccessful yarn joining operation (No yarn) | No yarn breakage signal<br>No yarn | Yarn supply bobbin changing operation |
| Unsuccessful yarn joining operation | No yarn breakage signal<br>Yarn is present | Yarn joining operation |

What is claimed is:

1. In a winder for winding yarn from a supply bobbin along a yarn path and to a take-up package, the winder having a slub catcher adjacent the yarn path, the method comprising the steps of:

transfering yarn along the yarn path toward the take-up package;

providing a first signal with the slub catcher upon an end of yarn extending from the take-up package passing the slub catcher;

changing the supply bobbin with a second supply bobbin in response to the first signal provided by the slub catcher;

detecting a slub in the yarn along the yarn path with the slub catcher and providing a yarn breakage signal upon the detection of the slub;

providing a second signal with the slub catcher upon an end of yarn extending from the supply bobbin passing the slub catcher; and joining an end of yarn extending from the take-up package with an end of yarn extending from the supply bobbin in response to either of the second signal or the yarn breakage signal provided by the slub catcher.

2. A method as claimed in claim 1, further comprising the step of retracting the yarn end extending from the supply bobbin past the slub catcher upon a yarn severence occurring in the yarn extending between the slub catcher and the take-up package.

3. In a winder for winding yarn from a supply bobbin to a take-up package, the winder having a bobbin changing device for replacing the supply bobbin with a second supply bobbin and a slub catcher having a yarn passage along which yarn wound from the supply bobbin may run and means for providing a signal dependent on the presence of yarn running in the yarn passage, a method of controlling the winding of yarn comprising the steps of:

transfering yarn along the yarn passage of the slub catcher;

providing a first signal with the slub catcher upon an end of yarn extending from the take-up package passing along the yarn passage of the slub catcher during said step of transfering; and replacing the supply bobbin with the second supply bobbin in response to the first signal provided by the slub catcher.

4. A method as claimed in claim 3, wherein the winder further comprises a yarn joining device for joining an end of yarn extending from the take-up package with an end of yarn extending from the supply bobbin, the method further comprising the steps of:

providing a second signal with the slub catcher upon an end of yarn extending from the supply bobbin being retracted along the yarn passage of the slub catcher;

joining an end of yarn extending from the take-up package with the end of yarn extending from the supply bobbin in response to the second signal provided by the slub catcher.

5. A method as claimed in claim 4, wherein the winder further includes means for retracting a yarn end of yarn extending from the supply bobbin along the yarn passage of the slub catcher, the method further comprising the step of retracting the yarn end extending from the supply bobbin along the yarn passage of the slub catcher upon a yarn severence occurring in the yarn extending between the slub catcher and the take-up package.

6. A method as claimed in claim 4, wherein the slub catcher further has means for detecting a slub in the yarn along the yarn passage and means for providing a yarn breakage signal upon the detection of the slub, the method further comprising the step of joining an end of yarn extending from the take-up package with an end of yarn extending from the supply bobbin in response to the yarn breakage signal provided by the slub catcher.

7. A method as claimed in claim 2, wherein the slub catcher further has means for detecting a slub in the yarn along the yarn passage and means for providing a yarn breakage signal upon the detection of the slub, the method further comprising the step of joining an end of yarn extending from the take-up package with an end of yarn extending from the supply bobbin in response to the yarn breakage signal provided by the slub catcher.

8. In a winder for winding yarn from a supply bobbin to a take-up package, the winder having a yarn joining device for joining an end of yarn extending from the take-up package with an end of yarn extending from the supply bobbin, a slub catcher having a yarn passage along which yarn wound from the supply bobbin may run means for retracting a yarn end of yarn extending from the supply bobbin along the yarn passage of the slub catcher and means for providing a signal dependent on the presence of yarn running in the yarn passage, a method of controlling the winding of yarn comprising the steps of:

retracting the yarn end extending from the supply bobbin along the yarn passage of the slub catcher upon a yarn severence occurring in the yarn extending between the slub catcher and the take-up package;

providing a signal with the slub catcher upon an end of yarn extending from the supply bobbin being retracted along the yarn passage of the slub catcher;

joining an end of yarn extending from the take-up package with the end of yarn extending from the supply bobbin in response to the signal provided by the slub catcher.

9. A method as claimed in claim 8, wherein the slub catcher further has means for detecting a slub in the yarn along the yarn passage and means for providing a yarn breakage signal upon the detection of the slub, the method further comprising the step of joining an end of yarn extending from the take-up package with an end of yarn extending from the supply bobbin in response to the yarn breakage signal provided by the slub catcher.

* * * * *